United States Patent [19]

Hensel, Jr.

[11] 4,071,099

[45] Jan. 31, 1978

[54] METHOD AND APPARATUS FOR STABILIZING BOREHOLE CORES

[75] Inventor: Wilber M. Hensel, Jr., Richardson, Tex.

[73] Assignee: Sun Oil Company, Dallas, Tex.

[21] Appl. No.: 706,649

[22] Filed: July 19, 1976

[51] Int. Cl.[2] ..... E21B 49/02; G01N 1/02

[52] U.S. Cl. ..... 175/59; 73/425.2; 175/226

[58] Field of Search ..... 175/58, 59, 60, 226, 175/17, 4, 249; 73/421 R, 425.2, 425.4 R; 166/57, 302, 285; 52/135; 62/293, 337, 66, 62; 426/249; 249/149, DIG. 4; 425/447–449

[56] References Cited

U.S. PATENT DOCUMENTS

| | | | |
|---|---|---|---|
| Re. 20,969 | 1/1939 | Reichel | 62/66 X |
| 843,314 | 2/1907 | Waters | 52/135 X |
| 2,880,969 | 4/1959 | Williams | 175/226 |
| 3,012,622 | 12/1961 | Austin | 175/226 |
| 3,064,742 | 11/1962 | Bridwell | 175/226 |
| 3,091,194 | 5/1963 | Dickinson | 62/66 X |
| 3,318,394 | 5/1967 | Gleason, Jr. et al. | 73/421 R X |
| 3,447,615 | 6/1969 | Schick | 73/421 R X |
| 3,461,192 | 8/1969 | Di Stasio | 249/DIG. 4 |
| 3,589,665 | 6/1971 | Onesti et al. | 249/DIG. 4 |

FOREIGN PATENT DOCUMENTS

| | | | |
|---|---|---|---|
| 92,126 | 4/1938 | Sweden | 175/226 |

OTHER PUBLICATIONS

The Oil and Gas Journal, "Crumbly cores? Dip them in plastic and freeze", May 31, 1965, p. 40.

*Primary Examiner*—Stephen J. Novosad
*Attorney, Agent, or Firm*—J. Edward Hess; Donald R. Johnson; James H. Phillips

[57] ABSTRACT

A method of and apparatus for stabilizing oil well cores taken within rubber sleeve core barrels is provided wherein an unconsolidated and friable columnar mass of earth may be handled without altering the characteristics of its physical structure. A housing is therein provided for receiving a conventional rubber sleeved core sample from a vertically suspended core barrel inside a drilling rig. The housing is adapted for the positioning of the ensleeved core therein and the circulation therearound of a subfreezing mass for the freezing and solidification of the core fluids contained therethrough. Freezing of the core fluids immobilizes rock grains and the like, stabilizing the core sample for handling and second stage stabilization through rigid encasement in a casting medium. The casted core may then be handled in a conventional manner during transportation for subsequent analysis in its original condition.

15 Claims, 5 Drawing Figures

METHOD AND APPARATUS FOR STABILIZING BOREHOLE CORES

BACKGROUND OF THE INVENTION

The invention relates to a method of and apparatus for receiving and handling core material, and, more particularly, to a method of and apparatus for stabilizing the cores taken within rubber sleeve core barrels.

It is generally the practice when drilling oil and gas wells to recover whole vertical sections of prospective geological formations at various depths in the drilling operation. This routine sampling is called coring and aids in determing the geological characteristics of the sub-structure. Such steps have, since the inception of deep hole drilling, been integral to proper drilling rig operations in the ultimate analysis of a particular area for oil and gas content. Consequently, coring devices have been developed for recovering columnar masses of core material from deep in the earth. The core materials are then brought to the surface for examination.

Prior art coring apparatus has included specially designed cutting heads in the form of hollow drill bits affixed to the end of elongated structures called core barrels. Conventional coring devices are generally comprised of stationary inner and rotatable outer barrels. The outer barrel rotates with the drill pipe and rotates the drill bit. As the formation is penetrated, the "core" is fed into the inner barrel. When a sufficient core sample has been taken and/or the inner barrel of the barrel is full, it is raised to the surface for subsequent analysis.

The conventional core barrel having been withdrawn from the well, is generally vertically suspended in the derrick above the rig floor for removal of the core. The most commonly utilized prior art methods and apparatus for recovering the core sample therefrom include an antiquated manual technique wherein the raw core sample is sectionally exposed and broken off. This less than optimal technique fostered the development of improved core recovery apparatus, among which has been the rubber sleeve core barrel.

Recovery of geological rock formations which are soft and unconsolidated in nature is greatly facilitated by core barrels which encase the core in a rubber sleeve as it is being bored. Such cores are generally about twenty feet in length and on the order of three inches in diameter. The original diameter of the generally heavy walled Neoprene rubber sleeve is less than three inches so that in its expanded capacity, it gives some measure of support to the core material contained therein. In this manner, the encased core may be removed from the suspended core barrel in one piece while substantially maintaining the physical integrity thereof.

Removal of the encapsulated core from the core barrel is generally effected while both are suspended from the derrick. First the core barrel is disassembled to expose the encapsulated core. The upper area of the rubber sleeve is then manually cut and wrestled to the floor of the rig. Similarly, the encapsulated core must generally be wrenched into numerous contortions in order to remove it from the rig. During these manual procedures the encapsulated core is subjected to blending, twisting and distortion, imparting physical strain to the core which inherently causes relative movement between rock grains and skeletons therein affecting physical properties such as permeability. Fragile rock skeletons may then collapse or become disoriented and repositioned as compared to their initially bored and received condition. Such alterations of the core configuration are particularly observable in friable formations where particles are loosely cemented together and fluid fills the spaces therebetween. Moreover, loosely consolidated formations are indigenous to areas in the Southern portion of the United States and Northern Mexico where satisfactory recovery of core samples is a must in effective oil and gas prospecting operations.

It would be an advantage therefore, to overcome the disadvantages of prior art encapsulated core recovery methods and apparatus by providing means for the immobilization and stabilization of the rock grains and skeletons contained therein prior to removal of the suspended core from the derrick and the handling associated therewith. The method and apparatus of the present invention are provided for just such a purpose. The encapsulated core is solidified through freezing while suspended in the derrick to allow for requisite handling without adversely affecting the physical properties thereof. In addition, the solidified core may also be rigidly encased in a casting medium to provide the desirable longitudinal rigidity thereto after the core thaws. In this manner the core is thereby prepared for transportation to a remote location for study and evaluation in its original condition.

SUMMARY OF THE INVENTION

The invention relates to a method of and apparatus for stabilizing encapsulated core material which includes imparting structural rigidity to said core material through freezing and/or encapsulation casting prior to the handling thereof. More particularly, one aspect of the invention involves a container for receiving and housing an encapsulated core therein and deelevating the temperature thereof beneath the freezing point of fluids normally found within the core. The deelevation in temperature may be effected by the introduction of subtemperate mass into the container, such as liquid nitrogen or dry ice. The solidified core may then be handled and transported without affecting the physical properties thereof.

In another aspect, the invention includes an elongated housing having sidewalls therearound adapted for thermally insulating an encapsulated core received therein and subtemperate mass introduced therearound. The housing preferably includes at least two longitudinal sections substantially separable one from the other for exposing the core contained therebetween. Suitable porting and venting apertures may be provided for accomodating the introduction and containment of subtemperate mass forms such as liquid nitrogen and/or dry ice.

In yet another aspect, the invention includes apparatus for utilizing a casting medium to stabilize a columnar mass of core material encapsulated within an expandable sleeve. The apparatus includes an elongated housing adapted for the receipt and containment of the encapsulated core and means for introducing the casting medium substantially around and longitudinally along the core disposed therein. Means for shielding an arcuate longitudinal portion of the core from the casting medium may be provided to facilitate access to the encased core.

In a further aspect, the invention includes a method of stabilizing a columnar mass of core material containing fluids therein and encapsulated within an expandable sleeve. A container is provided for housing an encapsulated core which is received therein. A subtemperate mass is supplied and introduced within the housing and substantially around the core for solidifying the fluids contained therein. The core is then allowed to deelevate in temperature beneath the freezing point of the fluids contained therein for solidification thereof. The subtemperate mass may be comprised of liquid nitrogen, dry ice or similar materials.

In a still further aspect, the invention includes a method of stabilizing a columnar mass of core material encapsulated within an expandable sleeve wherein a casting medium is utilized to solidify substantially around and longitudinally along the core to impart longitudinal rigidity thereto. The method may include shielding an arcuate, longitudinal portion thereof from the casting material to facilitate access thereto for analysis. The casting of the core may also be utilized as a follow up step to the freezing method set forth above or in lieu thereof as particular applications permit.

BRIEF DESCRIPTION OF THE DRAWINGS

For a more complete understanding of the present invention and for further objects and advantages thereof, reference may now be had to the following description taken in conjunction with the accompanying drawings, in which.

DETAILED DESCRIPTION

Figure 1:
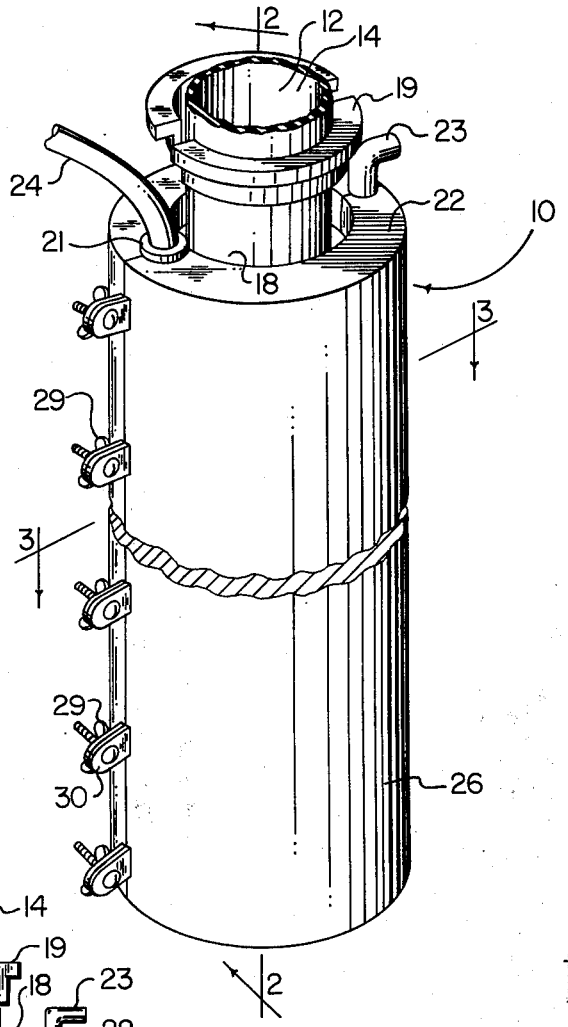
FIG. 1 is a fragmentary, perspective view of one embodiment of a container constructed in accordance with the principles of the present invention and adapted for the stabilization of an encapsulated core through the deelevation in temperature thereof.
Figure 2:
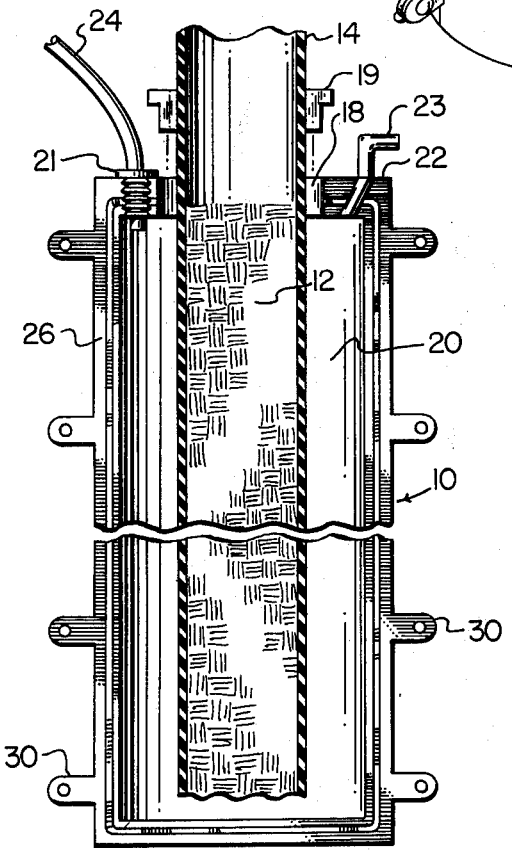
FIG. 2 is a fragmentary, side elevational, cross-sectional view of the container of FIG. 1 taken along lines 2—2 and illustrating the positioning of an encapsulated core therein.

Referring first to FIGS. 1 and 2, there is shown in FIG. 1 a perspective view of one embodiment of apparatus constructed in accordance with the principles of the present invention and adapted for the stabilization of encapsulated core material. The apparatus as shown includes a housing 10 adapted for receiving a generally vertically suspended columnar mass of core material 12, as representatively shown in FIG. 2. The core 12, disposed within the housing 10, is therein subject to stabilization through the deelevation in temperature and solidification of the fluids inherently found in masses of earth taken in cored sections.

The housing 10 as shown in FIG. 1 is preferably constructed for receiving columnar masses of the encapsulated core 12 which are generally vertically suspended beneath supporting structure thereabove. Such supporting structure (not shown) may include conventional drilling rig apparatus of the type utilized for drilling and coring sections of earth in exploration of oil and/or gas. Similarly, the method and apparatus for encapsulation of the core material may include the generally conventional process often utilized in oil and gas exploratory drilling wherein an expandable sleeve 14, usually made of rubber, or the like, encapsulates earthen mass as it is cored in the depending borehole. In this manner, the method and apparatus provided herein are particularly applicable to oil and gas well drilling operations wherein following coring procedures an elongated, tubular extension of rubber encapsulated earth may hang within the derrick above the rig floor for subsequent retrieval and analysis.

Accurate analysis of the encapsulated core 12 necessitates subsequent presentation of the subject mass for examination of its physical properties in its originally extracted condition. Bending and twisting of the columnar mass through conventional handling will affect the internal physical properties, and therefore such uncontrollable handling of the core 12 preferably would be eliminated. By stabilizing the core 12 while it is still suspended in the derrick and prior to conventional handling, the side effects therefrom may be eliminated. The housing 10 is thus preferably constructed for receiving the subject columnar mass while it remains vertically suspended. In this manner all handling thereof is subsequent to its prior stabilization, effected by the introduction of subtemperate mass therearound. As used herein, the term subtemperate mass refers to matter having a temperature substantially beneath the freezing point of the fluids normally contained in the extracted section of earth comprising the core 12.

The housing 10 is constructed for facilitating longitudinal entry of the core 12 through an upper aperture 18. Once positioned within the housing 10, an optional sealing ring 19, preferably of bifurcated design, may be inserted around the upper neck of the core 12. Subtemperate mass 20 such as liquid nitrogen, dry ice, or the like, may then be introduced therein. A suitable inlet 21 is thus shown to be provided through an upper bulkhead 22 of the housing 10 for communication with a fluid line 24, or the like, adapted for carrying the mass 20 such as liquid nitrogen thereto. A relief valve 23, or the like, is preferably provided for releasing pressure buildup and/or purging the system. The space between the elongated core 12 and the sidewalls 26 of the housing 10 comprises an annular void that the subtemperate mass 20 is allowed to fill. Sidewalls 26 are preferably insulated to reduce the rate at which the subtemperate mass 20 is heated from the outside environment. In this manner, complete solidification of the core 12 may be effected with a minimal supply of liquid nitrogen, or the like. Moreover, during periods of high temperature and winds, convection-conduction heat losses could create serious operational difficulties without suitable insulation along the sidewalls 26.

Figure 3:
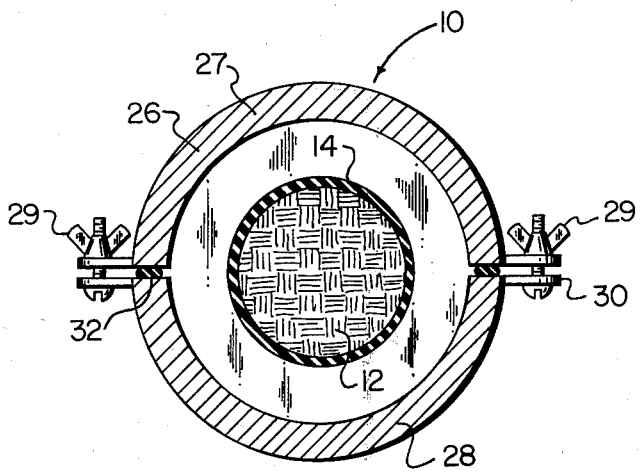
FIG. 3 is a top plan, cross-sectional view of the container of FIG. 1 taken along the lines 3—3 and illustrating one embodiment of the construction of said container.

Referring now to FIG. 3, there is shown a top plan, cross-sectional view of the housing 10 and core 12, wherein it may be seen that suitable structural and sealing means are provided for the sealed confinement of the subtemperate mass 20 and the core 12 as well as subsequent access thereto. Housing 10 is therefore preferably constructed of a dimidiate, or bisected, construction including two longitudinal sections 27 and 28. The sections 27 and 28 are connected by fasteners, such as the combination illustrated of bolt-wingnuts 29, or the like, provided along abutting edges or sides. This assemblage permits the separation of the sections 27 and 28 for access to the core 12 contained therein. A plurality of spaced flanges 30 are thus shown positioned on opposing edge sections of said halves and in registry with opposite ones thereof and adapted for receiving the bolt-wingnut combinations 29. A suitable gasket 32 is similarly provided between abutting faces of mating edges of each of the housing halves 27 and 28 for providing sealed engagement therebetween for closed containment of subtemperate mass therein.

The assemblage of housing halves 27 and 28 comprises a tubular structure adapted for receiving and stabilizing a columnar mass such as core 12. Stabilization through fluid solidification preferably occurs while the columnar mass is vertically suspended and prior to conventional handling which would affect the physical properties thereof. It is thus preferable to receive the core 12 while it remains suspended and similarly, to freeze it in the same configuration. Subsequent handling may then be conventionally effected without the detrimental effects generally associated therewith.

The solidified encapsulated core 12 may then be removed from within the derrick and suspending drill stem (not shown) by any of the conventional techniques normally incorporated. One such technique includes severing the core from the drill stem by the cutting of the rubber sleeve at its uppermost portion nearest the drill stem connection. Such a procedure releases the core 12, which, due to its size, generally weighs many hundreds of pounds. It is thus preferable for practical reasons to support the lower end thereof prior to the severing operation. The core itself may also be left within the housing 10 for containment during its release in order to facilitate handling. Other circumstances such as the amount of room on the drilling rig floor, the type of subtemperate mass 20 utilized, and whether or not the core 12 is to be quickly analyzed or transported to a remote location may also determine whether or not the core 12 is to be left within the housing 10. If the core 12 is to be transported in a manner in which keeping it "iced down", or solidified for later analysis would not be practical, a second stage stabilization step may be preferable, as hereinafter discussed.

Once the core 12 is solidified through freezing, it may be immediately handled as a length of rigid drill pipe would be and carried off of the drilling rig without adversely affecting its physical characteristics. However, once the core 12 is allowed to thaw, subsequent handling could be deleterious. For this reason, second stage stabilization through rigid encapsulation in a solidifying casting medium may be effected. As used herein, the term "casting medium" refers to material such as plaster of paris, quick setting epoxy, and the like, which may be poured in a fluid state for subsequent solidification. Following this procedure the core 12 may be transported and handled without time and temperature limitations.

Figure 4:
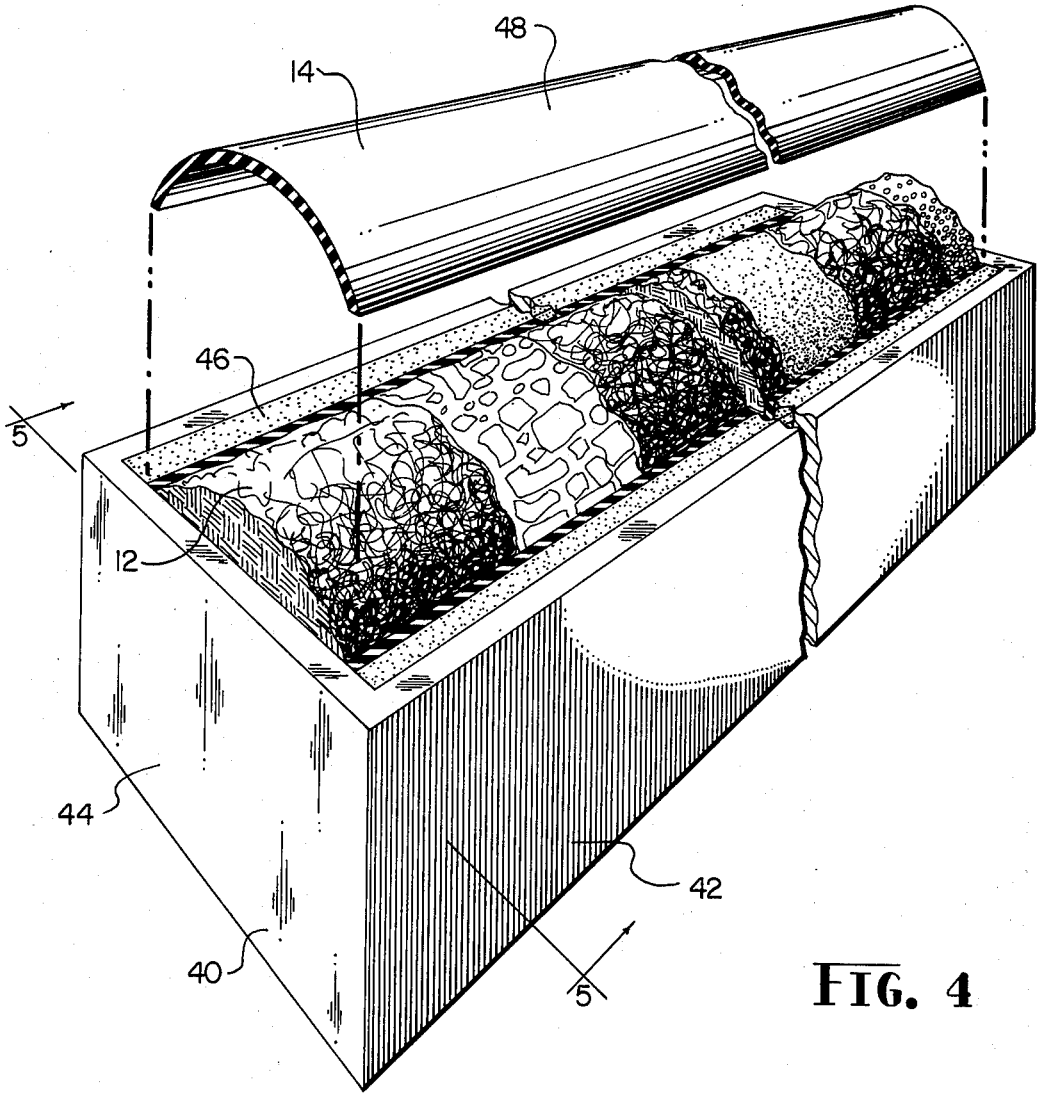
FIG. 4 is a fragmentary, perspective view of another embodiment of a container constructed in accordance with the principles of the present invention and adapted for the stabilization of an encapsulated core by the utilization of a casting medium.
Figure 5:
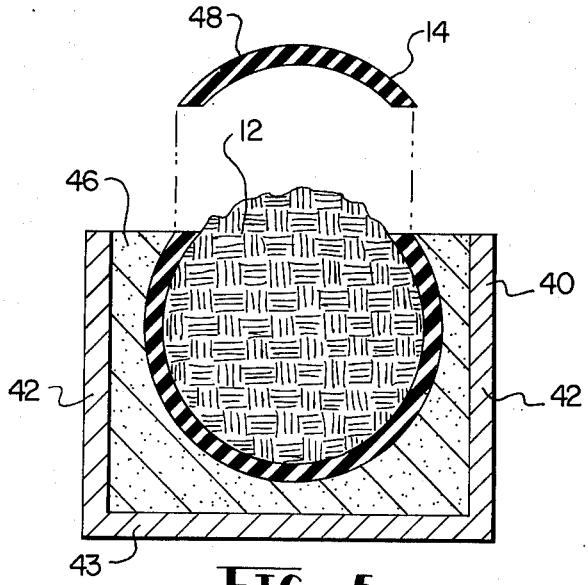
FIG. 5 is an end elevational cross-sectional view of the container of FIG. 4 taken along lines 5—5 thereof and illustrating the removal of an arcuate longitudinal section of encapsulation sleeving therefrom for the analysis of the core therein.

Referring now to FIGS. 4 and 5, there is shown a housing 40 constructed in accordance with one of the principles of the present invention and adapted for the stabilization of encapsulated core material by the utilization of a casting medium. The housing 40 is constructed of generally planar side and bottom walls 42 and 43, and, end walls 44 to comprise an elongated, open-top mold of sufficient size to receive the core 12 therein. Supporting members (not shown) may be provided along the length of the housing 40 for supporting the core 12 away from the bottom of said housing, as shown in FIG. 5. Such structural embodiments are not necessary since longitudinal rigidity may still be obtained when the core 12 rests along the bottom of the housing 40. In either manner, the core 12 may be substantially encased in a solidified casting medium to provide the benefits thereof.

As shown in FIGS. 4 and 5, an arcuate longitudinal portion 48 of the core 12 has been shielded from the solidified casting medium 46 and is thus advantageously exposed. Because the arcuate portion 48 is substantially less than 180° in radial exposure, the core 12 is securely held within the cast of the housing 40, while a sufficiently large portion is exposed and subject to study. In this configuration, the rubber encapsulation may be easily removed to reveal the core material inside. Unlike prior art methods of analysis, a longitudinal strip of encapsulation rubber may be lifted in its entirety to reveal the mass inside. With prior art techniques, only incremental segments of the encapsulation rubber could be removed since only the rubber sleeve held the core together.

It may be readily seen that the second stage stabilization method and apparatus described above, wherein a casting medium is utilized, may be an effective stabilization technique by itself. In some instances it may be possible to orient the core 12 into a horizontal configuration for casting without first having to freeze it. In such advantageous circumstances the core 12 may be encapsulated without first being solidified as set forth above. Similarly, it may be possible to encapsulate the core 12 in a vertical position, prior to handling, although such a step would require unnecessary and expensive rig time as well as creating procedural problems. For example, it is preferable to shield an arcuate longitudinal portion of the core 12 for analysis exposure. When casting in a horizontal configuration as shown, such a step is made possible by supporting the arcuate, longitudinal, sampling portion of the core above the top surface of the poured casting medium 46. When casting the core 12 in any other configuration, shielding may necessitate special shielding or molding apparatus.

It is believed the operation and construction of the above-described method and apparatus of the present invention will be apparent from the foregoing description. While the methods and apparatus shown and described herein have been characterized as being preferred, it will be obvious that various changes and modifications may be made therein without departing from the spirit and scope of the invention as defined in the following claims.

What is claimed is:

1. A method of stabilizing a columnar mass of core material containing fluids therein and encapsulated within an expandable sleeve, said method comprising:

providing a container for housing an encapsulated core;

receiving the encapsulated core within the housing;

supplying a subtemperature mass of material having a temperature substantially less than that of the core;

introducing the subtemperate mass within the housing and substantially around the core for solidifying the fluids contained therein;

allowing the core to reach a temperature beneath the freezing point of the fluids contained therein for solidification thereof to permit the core to be handled in a conventional manner without adversely affecting the physical properties thereof; and casting the core in a solidifying medium for imparting longitudinal rigidity thereto.

2. A method as set forth in claim 1 wherein the subtemperate mass is liquid nitrogen.

3. A method as set forth in claim 1 wherein the subtemperate mass is dry ice.

4. A method as set forth in claim 1 wherein the expandable sleeve is of the rubber sleeve core barrel variety adapted for encapsulating sections of earth.

5. A method of stabilizing a columnar mass of core material encapsulated within an expandable sleeve of the core variety adapted for encapsulating sections of earth, said method comprising:

providing a container for housing an encapsulated core;

receiving the encapsulated core within the housing;

introducing plaster of paris in a generally fluid condition into the housing, substantially around and longitudinally along the core for rigidly encasing it longitudinally therealong; and allowing the plaster of paris to solidify substantially around the core for imparting longitudinal rigidity thereto and allowing the casted core to be handled in a conventional manner without adversely affecting the physical properties thereof.

6. Apparatus for utilizing a subtemperature mass to stabilize a columnar mass of core material containing fluids therein and encapsulated within an expandable sleeve, said apparatus comprising:

an elongated housing adapted for the receipt and containment of the encapsulated core, said housing including at least two longitudinal sections substantially separable one from the other for exposing the encapsulated core therebetween;

means for introducing a subtemperate mass within said housing and substantially around the core disposed therein for solidifying the fluids contained therethrough; and means for providing access to the solidified encapsulated core within said housing for the subsequent analysis thereof.

7. Apparatus as set forth in claim 6 wherein said housing includes sidewalls therearound adapted for thermally insulating said encapsulated core therein and said subtemperate mass introduced therearound.

8. Apparatus as set forth in claim 6 wherein the subtemperate mass includes liquid nitrogen and said means for introducing the subtemperate mass within said housing includes a porting element for receiving the liquid nitrogen in substantially sealed communication with said housing.

9. Apparatus as set forth in claim 6 wherein the subtemperate mass is comprised of dry ice.

10. Apparatus as set forth in claim 6 wherein stabilization of the core is further effected by the introduction of a casting medium substantially therearound for imparting longitudinal rigidity thereto and said housing further includes at least two longitudinal sections substantially separable one from the other for exposing the encapsulated core to the introduction of the casting medium.

11. Apparatus for utilizing a casting medium to stabilize a columnar mass of core material encapsulated within an expandable sleeve, said apparatus comprising:

an elongated housing adapted for the receipt and containment of the encapsulated core;

means for introducing a casting medium within said housing and substantially around and longitudinally along the core disposed therein for imparting longitudinal rigidity thereto; and means included with said housing for shielding an arcuate, longitudinal portion of the core from the casting medium to prevent solidification therealong.

12. Apparatus as set forth in claim 4 wherein said housing includes means for shielding an arcuate, longitudinal portion of the core from the casting medium to prevent solidification therealong.

13. Apparatus as set forth in claim 11 wherein the casting medium is plaster of paris.

14. Apparatus as set forth in claim 11 wherein the casting medium includes an epoxy resin.

15. A method of stabilizing a columnar mass of core material encapsulated within an expandable sleeve of the core barrel variety adapted for encapsulating sections of earth, said method comprising:

providing a container for housing an encapsulated core;

receiving the encapsulated core within the housing;

supplying a solidifying casting medium in a generally fluid condition;

introducing the casting medium into the housing;

shielding an arcuate longitudinal portion of the core from the casting medium to prevent solidification therealong and provide subsequent access thereto;

distributing the casting medium substantially around and longitudinally along the core for rigidly encasing it longitudinally therealong; and allowing the casting medium to solidify around the unshielded portion of the core for imparting longitudinal rigidity thereto and allowing the casted core to be handled in a conventional manner without adversely affecting the physical properties thereof.

* * * * *